US006820740B1

(12) United States Patent
Spector

(10) Patent No.: US 6,820,740 B1
(45) Date of Patent: Nov. 23, 2004

(54) UNIVERSAL CAP FOR DISPENSING MATERIALS BY RETROFIT UPON EXISTING BOTTLED BEVERAGE CONTAINERS

(76) Inventor: Donald Spector, 380 Mountain Rd., Union City, NJ (US) 07087

( * ) Notice: Subject to any disclaimer, the term of this patent is extended or adjusted under 35 U.S.C. 154(b) by 0 days.

(21) Appl. No.: 10/463,927

(22) Filed: Jun. 18, 2003

(51) Int. Cl.[7] ..... B65D 25/08
(52) U.S. Cl. ..... 206/219; 215/250
(58) Field of Search ..... 206/219–222, 206/568; 215/6, 250, DIG. 8

(56) References Cited

U.S. PATENT DOCUMENTS

| | | | | | |
|---|---|---|---|---|---|
| 3,715,189 | A | * | 2/1973 | Nighohossian et al. | 206/219 |
| 4,011,945 | A | * | 3/1977 | Bourne et al. | 206/221 |
| 4,315,570 | A | * | 2/1982 | Silver et al. | 206/221 |
| 4,858,759 | A | * | 8/1989 | Mauthe et al. | 206/221 |
| 4,898,293 | A | * | 2/1990 | Morel | 206/222 |
| 5,419,445 | A | * | 5/1995 | Kaesemeyer | 206/220 |
| 6,138,821 | A | * | 10/2000 | Hsu | 206/222 |

* cited by examiner

*Primary Examiner*—Luan K. Bui
(74) *Attorney, Agent, or Firm*—Collard & Roe, P.C.

(57) ABSTRACT

A bottle cap for universal retrofitting to one of a number of pre-existing beverage containers containing a beverage and having a removed cap and threaded aperture, having at least one container portion for containing at least one dispensable material, a screwable attachment portion for receiving the threaded aperture and creating, when threaded, a water-tight assembly; and a parseable membrane substantially planarly located within the plane defined by a cross-section of the screwable attachment portion, such that on said membrane's one surface containment for said container portion is provided, and on its other surface an air barrier to the contained material is provided. Upon screwable attachment of the threaded aperture into the screwable attachment means, the threaded aperture parses at least a portion of the parseable membrane to permit feeding of the material into the beverage. A plurality of such caps are also shown packaged for commercial sale. The material contained in the cap is selected from the group consisting of vitamins, medicaments, teas, flavors, concentrates and water-soluble food material. Also shown is a universal cap further having a moveable aperture assembly creating an open, fluid-flowing state and a closed, fluid-stopped state, having a top portion containing a drinking aperture and an elongated, moveable fluid-flowing portion.

4 Claims, 6 Drawing Sheets

UNIVERSAL CAP FOR DISPENSING MATERIALS BY RETROFIT UPON EXISTING BOTTLED BEVERAGE CONTAINERS

FIELD OF THE INVENTION

The present invention relates to the field of beverages, and more specifically to beverages contained in bottles with removal caps, such that a cap can be retrofittedly placed upon said bottle, post removal of its originating cap, in a manner that dispenses materials including e.g., vitamins and flavors, into the beverage.

BACKGROUND OF THE INVENTION

The beverage world today is largely possessed by bottled water contained in plastic bottles having virtually identical removable caps. Such caps are removed by twistable action, leaving a band or collar behind as the cap is removed, while simultaneously providing access for drinking to the top of the bottle. Beverages also comprise pre-mixed drinks with a plurality of different designs, requiring, among other things, refrigeration, dates of expiration and other indicators related to the shelf-life of the beverage.

Well known in the art are water-soluble drink mixes that are sold in solid form. The consumer measures quantities of the dry material, adds the quantities in the proper ratio to water, and creates a flavored beverage. In these embodiments, the consumer is required to modulate the quantities, and mistakes result in under or over-flavored mixtures.

It is important to maintain freshness of fluid-based products. This is especially so when the material to be dispensed is vitamin-based, since it is known that water-miscible vitamins can lose their potency over time when in a fluid environment, through changes in, inter alia, temperature, pressure, and light.

Heretofore unknown in the art, is a universal cap design that contains dry or concentrated materials including, e.g., vitamins, drink mixes and other flavors, such that the cap is capable of utilization with any number of fluid containers, predominantly water, without the need for modification of the existing, standard, plastic bottle design. In other words, once the pre-existing cap is removed, the new cap, containing the materials, can be retrofittedly installed upon the bottle top, dispensing the materials into the fluid. The result can be shaken and the completed beverage created moments before consumption.

Known devices include U.S. Ser. No. 2003/0072859 to Burniski, U.S. Pat. No. 6,098,795 to Molistram, U.S. Pat. No. 5,772,017 to Kange, U.S. Pat. No. 5,246,142 to DiPalma, and U.S. Pat. No. 2,859,898 to Mendenholl. These devices, however, incorporate convoluted mechanisms that do not permit retrofitting to pre-existing bottle designs, and rather have cumbersome mechanisms for rotation and dispensation. Moreover, from the practical consumer vantage point, at purchase point, both an associated cap and fluid product must be acquired in pre-packaged form. Unknown is the disassociation of the two, permitting the consumer to purchase, independently, caps with a plurality of different materials contained therein, and standard, plastic fluid bottles.

It is thus an object of the instant invention to provide a universal, single-use cap containing materials for attachment to pre-existing fluid containers to permit dispensation of materials thereby maintaining the freshness of the beverage.

It is a further object of the instant invention to provide a universal cap in a plurality of different flavors for single-use attachment to pre-existing fluid containers, for simple access by a consumer.

It is a still further object of the instant invention to provide a plurality of universal caps having different materials, like vitamins, contained therein, such that consumers can independently purchase such caps from the decision to purchase their favorite forms of beverages, like water.

It is a still additional and further object of the instant invention to provide a plurality of universal caps having different flavors, like teas, contained therein, such that consumers can have fresh tea products in their favorite form of bottled water.

SUMMARY OF THE INVENTION

The various features of novelty which characterize the invention are pointed out with particularity in the claims annexed to and forming a part of the disclosure. For a better understanding of the invention, its operating advantages, and specific objects attained by its use, reference should be had to the drawings and descriptive matter in which there are illustrated and described preferred embodiments of the invention.

The foregoing objects and other objects of the invention are achieved through a bottle cap for universal retrofitting to one of a number of pre-existing beverage containers containing a beverage and having a removed cap and threaded aperture. In general, a majority of water and other beverages are packaged in a standard bottle having a removeable cap, leaving behind, upon its removal, screw threads. The cap of the subject invention mates with these screw threads to create a water-tight assembly by having a screwable attachment portion for receiving the screw threads of the top of the bottle.

The cap further has at least one container portion for containing at least one dispensable material. The material is selected from the group consisting of vitamins, medicaments, teas, flavors, concentrates and water-soluble food material.

The cap further has a parseable membrane substantially planarly located within the plane defined by a cross-section of the screwable attachment portion, such that on said membrane's one surface containment for said container portion is provided, and on its other surface an air barrier to the contained material is provided. Upon screwable attachment of the threaded aperture into the screwable attachment means, the threaded aperture parses at least a portion of the parseable membrane to permit feeding of the material into the beverage. Once parsed, the material freely flows into the beverage, either through gravitational action, shaking, or a combination thereof. Once fed into the beverage, the material disburses, creating a fresh beverage.

A plurality of such caps are also shown packaged for commercial sale. In this manner, different flavors or vitamin composition are provided, and a consumer can purchase virtually any beverage that has a suitably mating screw thread to the unique cap defined herein.

Also shown is a universal cap further having a moveable aperture assembly creating an open, fluid-flowing state and a closed, fluid-stopped state, having a top portion containing a drinking aperture and an elongated, moveable fluid-flowing portion.

Other features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein similar reference characters denote similar elements through the several views.

DETAILED DESCRIPTION OF THE PREFERRED EMBODIMENTS

Figure 1:
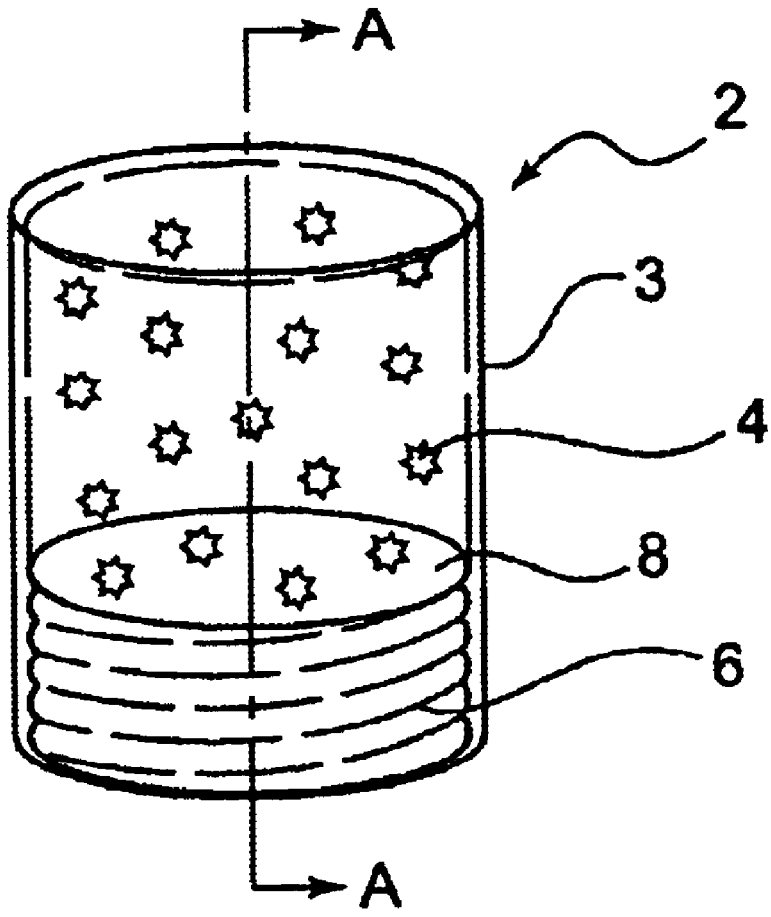
FIG. 1 is a perspective view of a cap in accordance with a preferred embodiment of the subject invention.

In accordance with the subject invention, FIG. 1 shows a perspective view of cap 2, having a container portion 3 containing material 4 for dispensation into a beverage, upon attachment. Also shown is a parseable membrane 8 planarly located within the confines of screw thread receiving means 6, for reasons shown and explained in greater detail in connection with FIG. 3.

Figure 2:
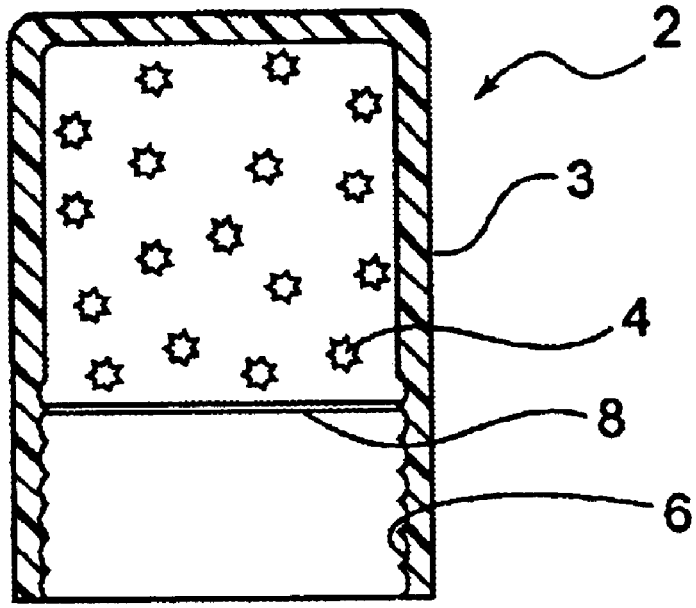
FIG. 2 is a cross-sectional view of the cap shown in FIG. 1, taken along line A—A shown therein.

FIG. 2 shows a cross-section of cap 2, shown in FIG. 1, taken along line A—A of FIG. 1, wherein container portion 3 is shown holding material 4, and membrane 8 is shown within the planar region of screw thread receiving means 6.

Figure 3:
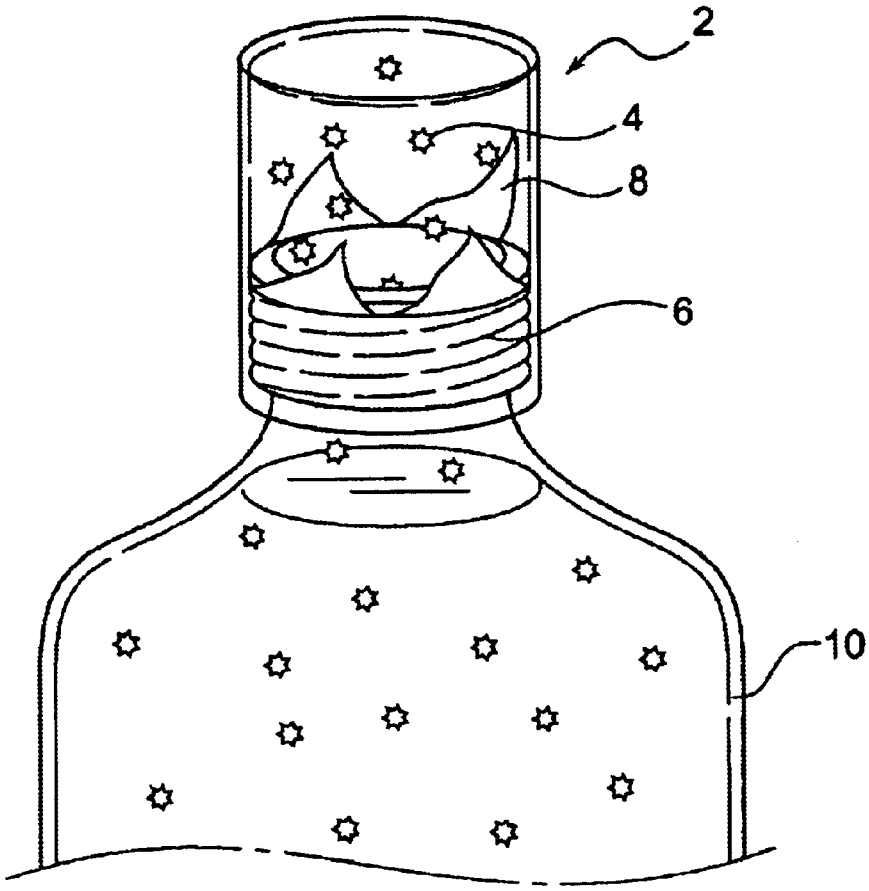
FIG. 3 is perspective view of the cap installed upon a bottled beverage container showing the parsing of the membrane and the dispensation of material, in accordance with a preferred embodiment of the subject invention.

FIG. 3 reveals the attachment of cap 2 to a bottle 10 containing a beverage, in which the screw threaded upper region of bottle 10 has parsed membrane 8, shown in parsed form therein, permitting material 4 to feed into the beverage. It should be understood that membrane 8 is simply parsed by the effect of screwing the upper threaded region of bottle 10 into the receiving means 6, and that no further action is required.

Figure 4:
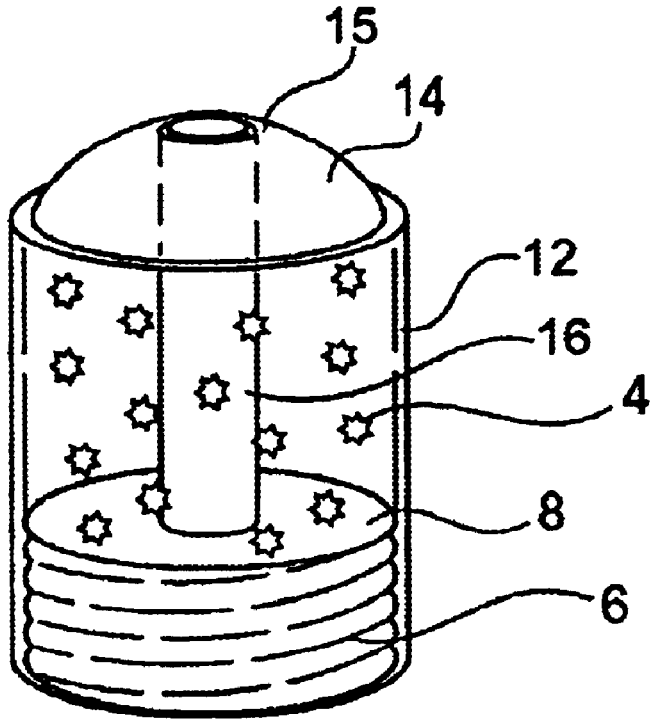
FIG. 4 is a perspective view of an alternative cap assembly having lockable fluid-stopped and fluid-flowing states, in accordance with an alternative embodiment of the subject invention.
Figure 5:
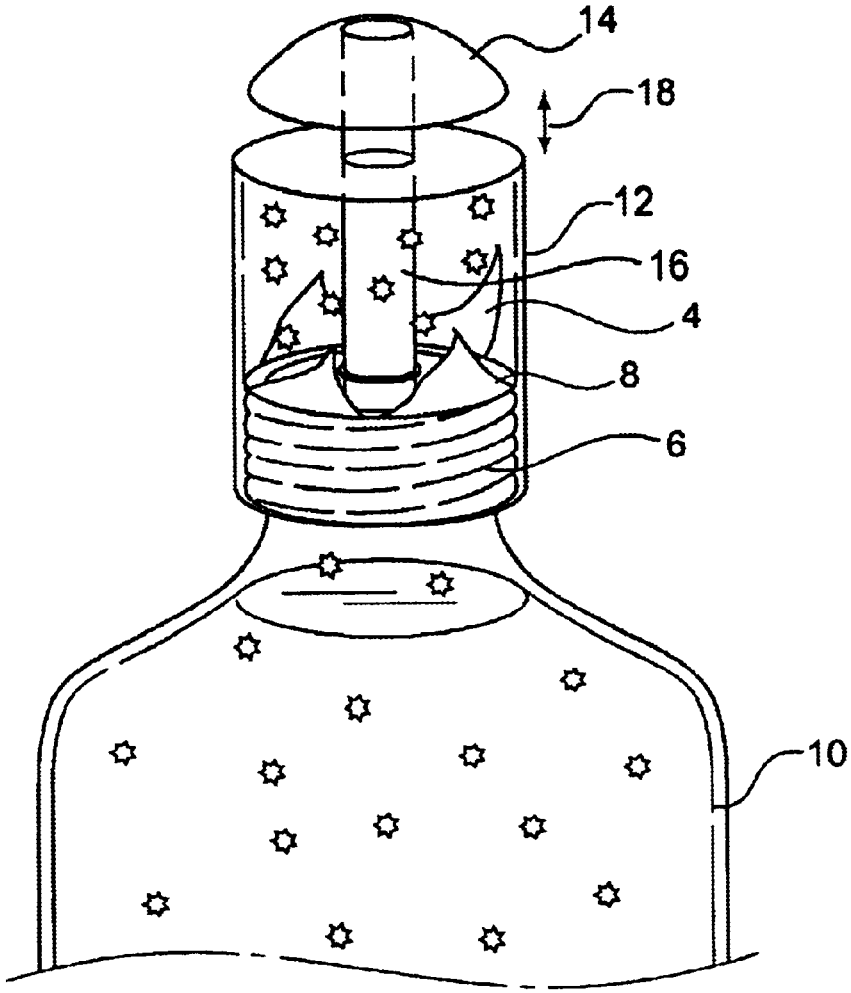
FIG. 5 is a perspective view of the alternative cap of FIG. 4, shown attached to a bottle in the fluid-flowing state.
Figure 6:
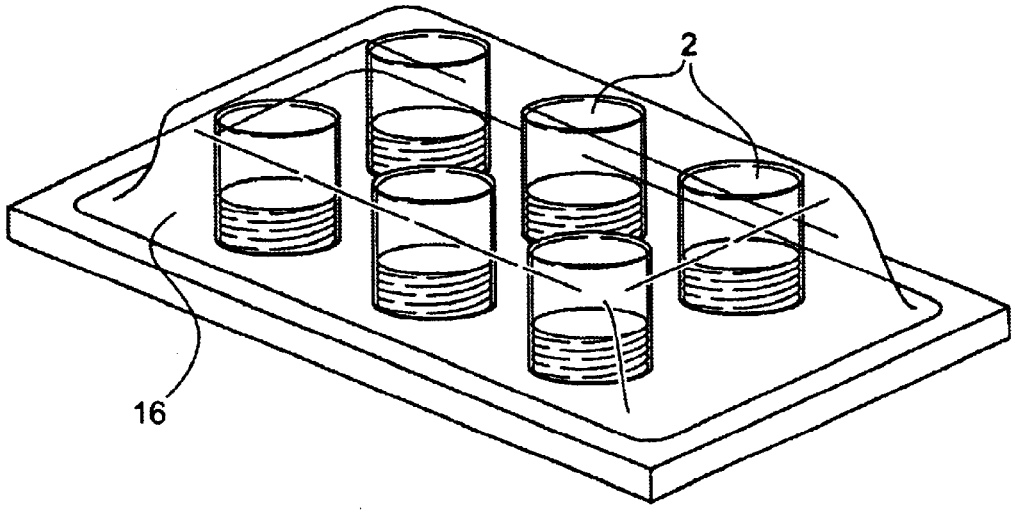
FIG. 6 is a perspective view of a plurality of caps in a consumer saleable package, in accordance with another embodiment of the subject invention.

FIG. 4 shows an alternative embodiment of a cap 12, having a moveable aperture assembly 14 creating an open, fluid-flowing state and a closed, fluid-stopped state, having a top portion 15 as a drinking aperture and an elongated, moveable fluid-flowing portion 16 which rides above membrane 8. It should be understood that portion 16 can also attach to membrane 8, such that screwable assembly does not break the membrane but, rather, only movement of assembly 14 breaks the membrane. In the state as shown in FIG. 4, however, the parsing of membrane 8 occurs upon screwable assembly, as shown in FIG. 5, wherein membrane 8 is shown parsed and material 4 is disbursed. Lastly, FIG. 6 shows a multiplicity of caps 2 in a consumer-saleable package design 16.

While there are been shown, described and pointed out fundamental novel features of the invention as applied to preferred embodiments thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

I claim:

1. A bottle cap for universal retrofitting to one of a number of pre-existing beverage containers containing a beverage and having a removed cap and threaded aperture, comprising:

(a) at least one container portion for containing at least one dispensable material;

(b) screwable attachment means for receiving the threaded aperture and creating, when threaded, a water-tight assembly; and (c) a parseable membrane substantially planarly located within the plane defined by a cross-section of the screwable attachment means, such that on said membrane's one surface containment for said container portion is provided, and on its other surface there an air barrier to the contained material is provided, and wherein upon screwable attachment of the threaded aperture into said screwable attachment means, the threaded aperture parses at least a portion of said parseable membrane to permit feeding of said material into the beverage.

2. The universal cap of claim 1, wherein a plurality of such caps are packaged for commercial sale.

3. The universal cap of claim 1, wherein said at least one material is selected from the group consisting of vitamins, medicaments, teas, flavors, concentrates and water-soluble food material.

4. The universal cap of claim 1, further comprising a moveable aperture assembly creating an open, fluid-flowing state and a closed, fluid-stopped state, having a top portion containing a drinking aperture and an elongated, moveable fluid-flowing portion.

* * * * *